US009416574B2

(12) United States Patent
Mitchell et al.

(10) Patent No.: US 9,416,574 B2
(45) Date of Patent: Aug. 16, 2016

(54) LIFT-OFF TYPE HINGE

(71) Applicant: Kason Industries, Inc., Newnan, GA (US)

(72) Inventors: Brett A Mitchell, Newnan, GA (US); Jeffery E Underwood, Newnan, GA (US)

(73) Assignee: Kason Industries, Inc., Newnan, GA (US)

( * ) Notice: Subject to any disclaimer, the term of this patent is extended or adjusted under 35 U.S.C. 154(b) by 53 days.

(21) Appl. No.: 14/160,223

(22) Filed: Jan. 21, 2014

(65) Prior Publication Data

US 2014/0215760 A1 Aug. 7, 2014

Related U.S. Application Data

(63) Continuation-in-part of application No. 13/760,997, filed on Feb. 6, 2013, now Pat. No. 8,800,109.

(51) Int. Cl.

| | |
|---|---|
| ***E05D 7/04*** | (2006.01) |
| ***E05D 11/00*** | (2006.01) |
| ***E05F 1/12*** | (2006.01) |

(52) U.S. Cl.

CPC ..... *E05D 7/0423* (2013.01); *E05D 11/0054* (2013.01); *E05F 1/1223* (2013.01); *E05Y 2600/634* (2013.01); *Y10T 16/535* (2015.01)

(58) Field of Classification Search

CPC ..... E05D 7/04; Y10T 16/54038
USPC ..... 16/238, 236, 245, 248, 309, 312
See application file for complete search history.

(56) References Cited

U.S. PATENT DOCUMENTS

| | | | | |
|---|---|---|---|---|
| 2,027,888 | A | 1/1936 | Solomon | |
| 2,458,707 | A * | 1/1949 | Jacobs | 296/97.11 |
| 2,581,104 | A | 1/1952 | Houlsby, Jr. | |
| 2,615,194 | A | 10/1952 | Kreiner | |
| 3,107,390 | A * | 10/1963 | Shelton | 16/224 |
| 3,626,548 | A | 12/1971 | Grunert | |
| 3,683,453 | A * | 8/1972 | McLeland et al. | 16/248 |
| 3,866,658 | A | 2/1975 | Smith | |
| 4,156,301 | A | 5/1979 | Schneider et al. | |
| D255,868 | S | 7/1980 | Berkowitz et al. | |

(Continued)

FOREIGN PATENT DOCUMENTS

WO WO 2011146887 A1 * 11/2011

*Primary Examiner* — Victor Batson
*Assistant Examiner* — Jason W San
(74) *Attorney, Agent, or Firm* — Baker, Donelson, Bearman, Caldwell & Berkowitz, PC; Dorian Kennedy

(57) ABSTRACT

There is disclosed anti-sag hinge (10) which includes a mounting flange assembly (12) pivotally coupled to a strap assembly (15). The strap assembly includes a strap (31) extending from a cylinder portion (32). The cylindrical portion includes a coupling end (34) with a vertically extending octagonal channel (35) therethrough. The octagonal channel includes a vertically extending alignment ridge or tongue (36) and a centrally positioned, horizontally oriented, annular ridge (37). The hinge also includes an elongated cam follower (40) having a lower cam follower portion (41) with an octagonal exterior surface (43) terminating at a circumferential ledge or shoulder (44) positioned to abut and bear against the centrally positioned annular ridge of the coupling end. The lower cam follower portion also has a longitudinally extending groove (53) configured to receive the coupling end alignment tongue.

19 Claims, 4 Drawing Sheets

(56) References Cited

U.S. PATENT DOCUMENTS

| | | | | |
|---|---|---|---|---|
| 4,386,449 | A | 6/1983 | Brustle et al. | |
| 4,407,044 | A | 10/1983 | Iseki | |
| 4,604,769 | A | 8/1986 | Rock et al. | |
| 4,630,333 | A * | 12/1986 | Vickers | 16/338 |
| 4,991,259 | A | 2/1991 | Finkelstein et al. | |
| 5,218,739 | A | 6/1993 | Lautenschlager | |
| 5,367,745 | A * | 11/1994 | Roloff | 16/312 |
| 5,491,930 | A | 2/1996 | La See | |
| D395,590 | S | 6/1998 | Finkelstein et al. | |
| 5,765,263 | A * | 6/1998 | Bolinas et al. | 16/342 |
| D401,134 | S | 11/1998 | Finkelstein | |
| 6,049,946 | A | 4/2000 | Cress et al. | |
| 6,148,479 | A | 11/2000 | Lin | |
| 6,152,554 | A | 11/2000 | Parisi | |
| 6,202,255 | B1 | 3/2001 | Sitter | |
| 6,230,365 | B1 * | 5/2001 | Lu | 16/342 |
| 6,374,458 | B1 | 4/2002 | Finkelstein | |
| 6,470,532 | B2 * | 10/2002 | Rude | 16/335 |
| 6,880,205 | B2 | 4/2005 | Rupprechter | |
| 7,055,214 | B1 | 6/2006 | Finkelstein | |
| 7,516,516 | B2 | 4/2009 | Wu | |
| 7,578,031 | B2 * | 8/2009 | Hung | 16/342 |
| 7,584,523 | B1 | 9/2009 | Finkelstein et al. | |
| 7,614,116 | B2 | 11/2009 | Chen et al. | |
| 7,870,642 | B1 | 1/2011 | Finkelstein et al. | |
| 7,891,055 | B1 * | 2/2011 | Combs | 16/342 |
| D637,060 | S | 5/2011 | Mitchell et al. | |
| D645,725 | S | 9/2011 | Katz et al. | |
| 8,020,253 | B1 | 9/2011 | Finkelstein et al. | |
| D658,031 | S | 4/2012 | Mitchell et al. | |
| 8,166,611 | B2 * | 5/2012 | Moon | 16/240 |
| 8,166,612 | B2 | 5/2012 | Bertolini et al. | |
| 8,250,705 | B2 | 8/2012 | Oshima | |
| 8,250,713 | B2 | 8/2012 | Lin | |
| 8,256,065 | B2 * | 9/2012 | Ikunami | 16/342 |
| 8,407,859 | B1 * | 4/2013 | Mitchell et al. | 16/312 |
| 8,505,166 | B2 | 8/2013 | Mitchell et al. | |
| 8,621,715 | B2 | 1/2014 | Mitchell et al. | |
| 8,959,717 | B2 * | 2/2015 | Billings et al. | 16/334 |
| 9,140,045 | B1 * | 9/2015 | Finkelstein | E05D 7/04 |
| 2004/0068840 | A1 | 4/2004 | Thomas et al. | |
| 2006/0137139 | A1 | 6/2006 | Wu | |
| 2007/0289094 | A1 | 12/2007 | Lowe et al. | |
| 2008/0016648 | A1 | 1/2008 | Lautenschlager | |
| 2008/0271291 | A1 | 11/2008 | Chen et al. | |
| 2010/0251520 | A1 * | 10/2010 | Corso et al. | 16/342 |
| 2013/0067687 | A1 * | 3/2013 | Mitchell | E05F 1/066 16/312 |
| 2013/0111706 | A1 * | 5/2013 | Anderson et al. | 16/342 |
| 2013/0219659 | A1 | 8/2013 | Oshima et al. | |
| 2014/0090204 | A1 * | 4/2014 | Sarnowski et al. | 16/340 |
| 2014/0259527 | A1 * | 9/2014 | Chung | 16/238 |
| 2015/0121655 | A1 * | 5/2015 | Lee | E05F 1/063 16/312 |

* cited by examiner

LIFT-OFF TYPE HINGE

REFERENCE TO RELATED APPLICATION

This is a continuation-in-part of U.S. patent application Ser. No. 13/760,997 filed Feb. 6, 2013.

TECHNICAL FIELD

This invention relates generally to door hinges, and more particularly to hinges used for commercial refrigerator and freezer doors.

BACKGROUND OF INVENTION

Walk-in cold rooms, such as walk-in coolers, freezers, or other refrigerated environments, are common in various industries, including supermarkets and grocery stores, commercial kitchens, and other food service facilities. They typically have one or more access doors for entry and exit.

These doors are heavy and thus a common problem that may occur over time is door sag, which may cause the door not to open freely as it drags against the underlying floor or be properly locked or sealed as it does not fully close. The sag is caused by hinge wear, structural shifting due to temperature cycling, impacts, abuse, poor design of the door and frame, or the hinges shifting on the mounting screws. Sag is difficult to overcome without extensive repair work, such as the removal and remounting of the hinges or the replacement of the door and frame. For the replacement, adjustment or cleaning of the hinge the NSF prefers that the hinge be a "lift-off" type to allow the door and the enclosure to be cleaned by lifting it off the hinges and hosing down the door assembly.

A problem associated with these "lift-off" type hinges is that the hinge spring is designed to move the cam past the point of door closure to ensure a complete closing of the door, this may be referred to as an over-closure angle between the hinge strap and hinge flange. As a result of the over-closure of the earn when the door is taken off the hinge, the subsequent replacement of the door upon the hinge flange does not always result in the proper alignment of the hinge strap upon the hinge flange. This problem can result in the poor closure function of the hinge, the misalignment of the hinge components, and/or damage to the hinge.

Accordingly, there is a need in the art for a hinge that will allow for the door to be lifted off easily, which does not promote door sag, which allows small adjustments to the hinge, and which properly aligns the hinge components when disassembled and subsequently reassembled. It is to the provision of such therefore that the present invention is primarily directed.

SUMMARY OF THE INVENTION

In a preferred form of the invention a hinge comprises a mounting flange assembly having a cam and a rotating cam follower configured to mate with the cam. The cam follower has an exterior surface and a longitudinally ending alignment groove extending inwardly fro the exterior surface. The hinge also has a strap assembly pivotally coupled to the mounting flange assembly. The strap assembly includes a strap having at least one strap mounting hole and a coupling end having a longitudinally extending channel therein configured to receive at least a portion of the mounting flange cam follower. The channel includes a longitudinally and inwardly extending alignment tongue configured to be received within the longitudinally extending alignment groove of the cam follower. With this construction, the proper alignment between the cam follower and the strap assembly may only occur when the alignment tongue aligns with and is received within the alignment groove.

DETAILED DESCRIPTION

Figure 1:
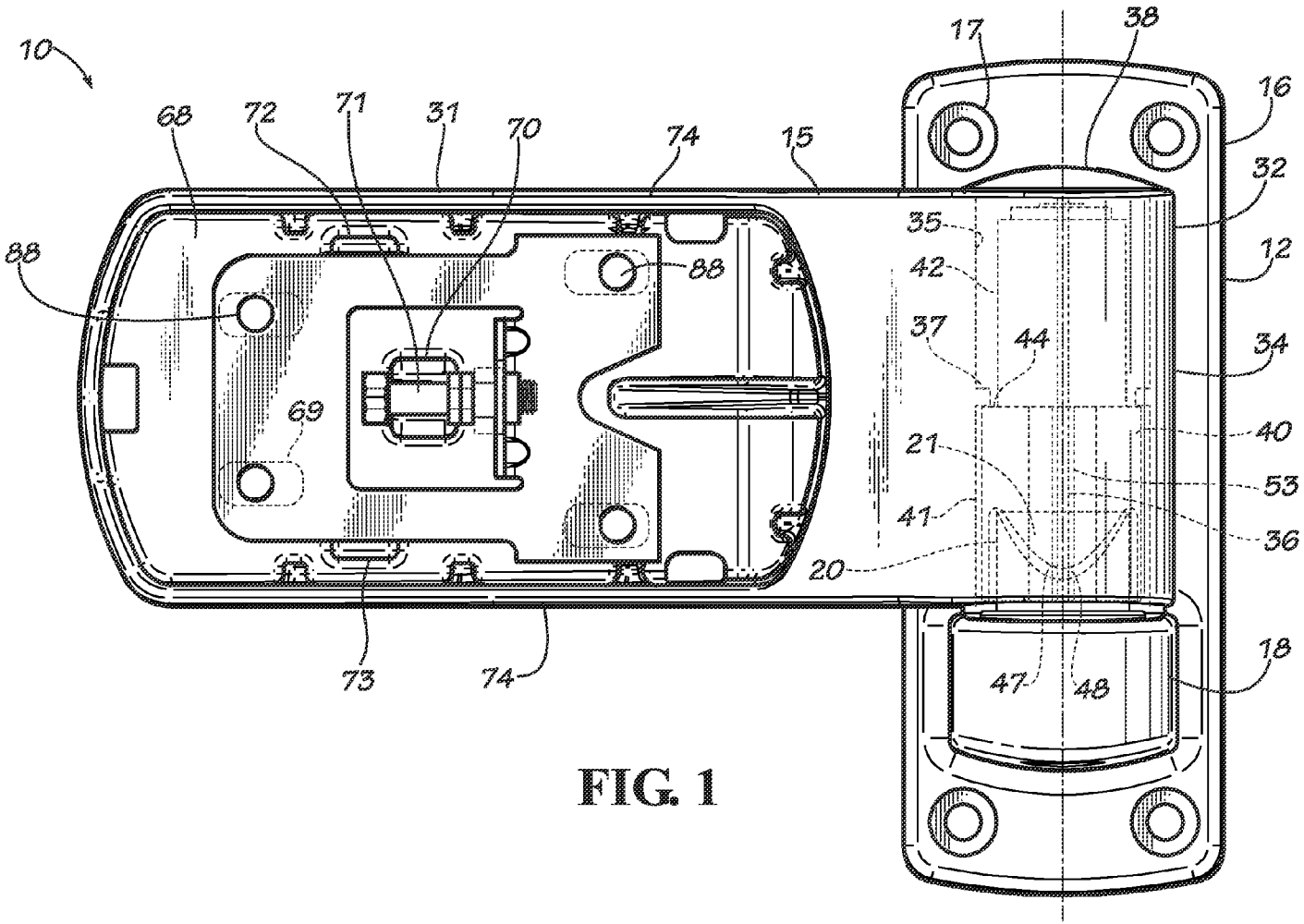
FIG. 1 is a front view of an anti-sag hinge embodying principles of the invention in a preferred form.
Figure 2:
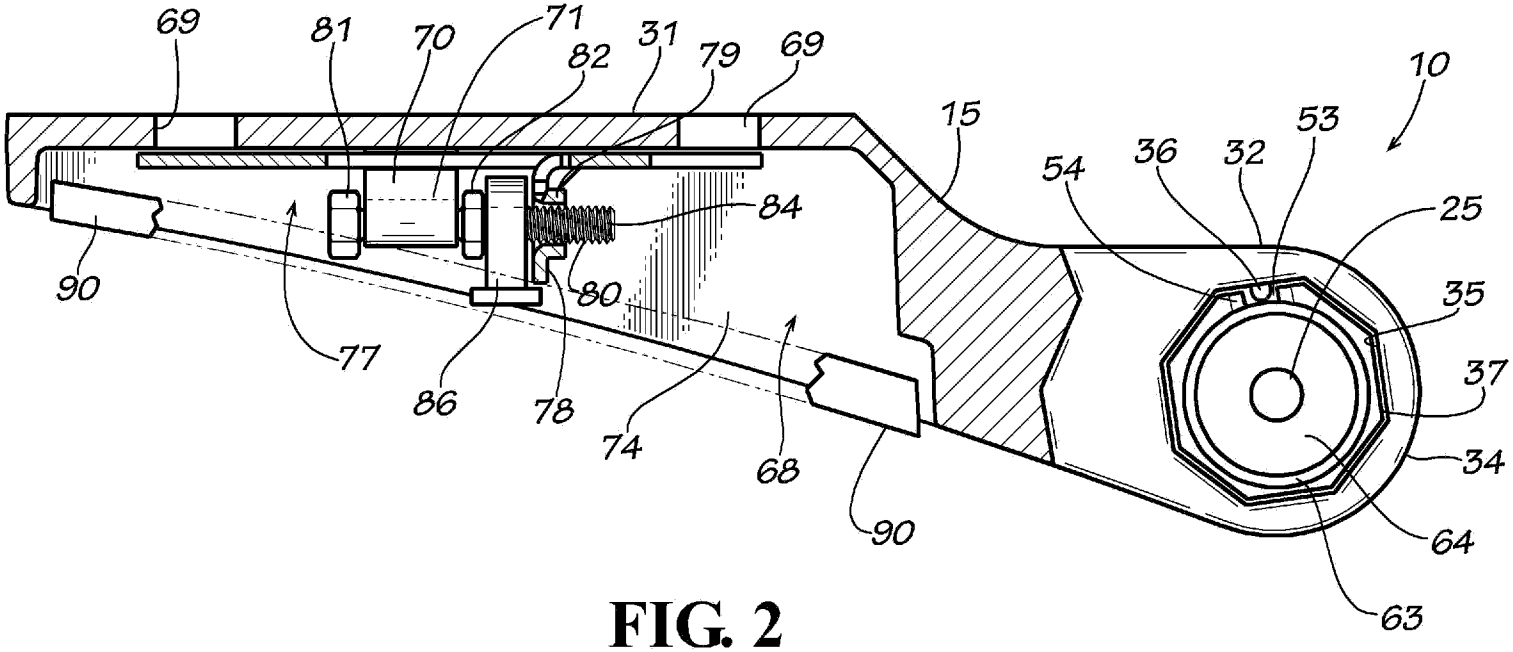
FIG. 2 is a top view of the anti-sag hinge of FIG. 1, shown in partial cross-section.
Figure 3:
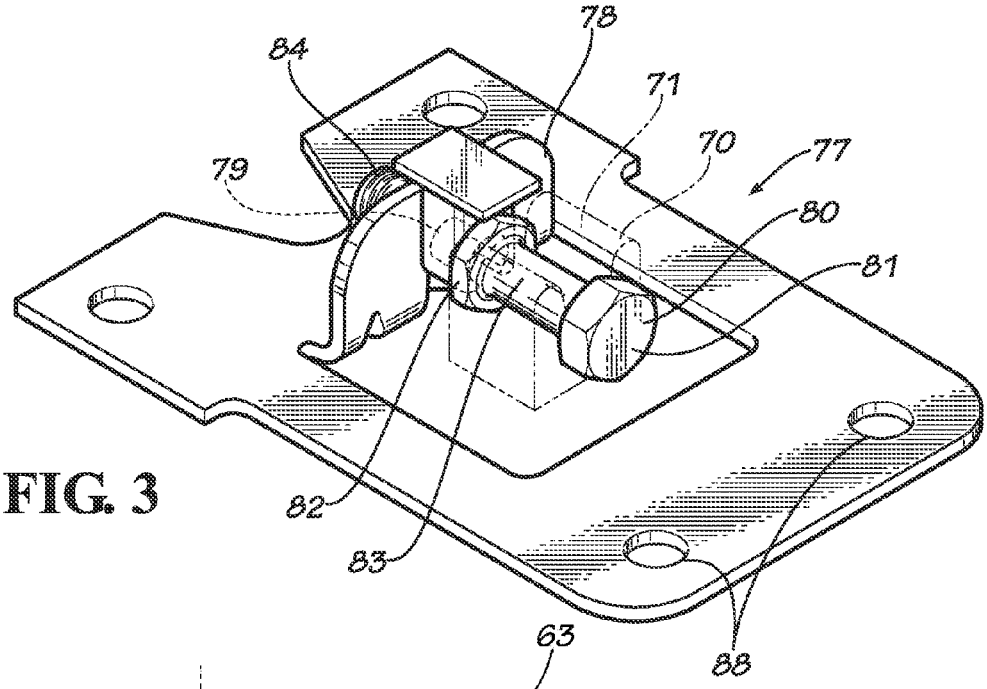
FIG. 3 is a perspective view of a portion of the anti-sag hinge of FIG. 1.
Figure 5:
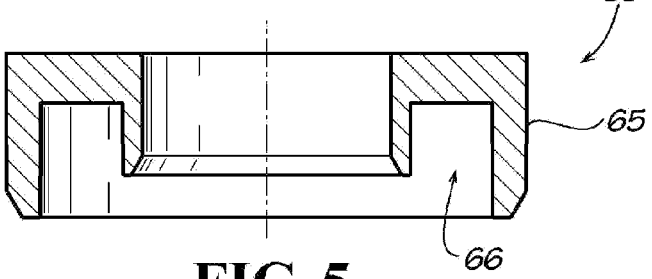
FIG. 5 is a cross-sectional view of a bushing of the anti-sag hinge of FIG. 1.
Figure 6:
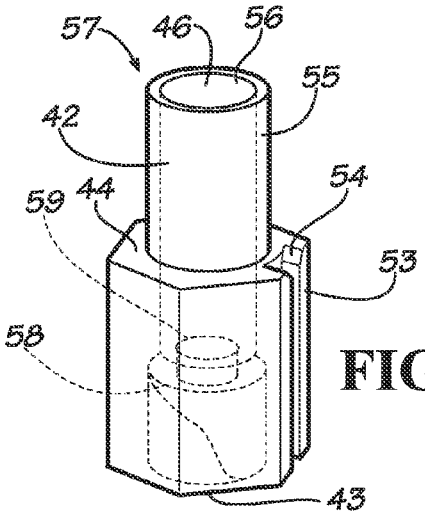
FIG. 6 is a perspective view of the cam follower of the anti-sag hinge of FIG. 1.
Figure 7:
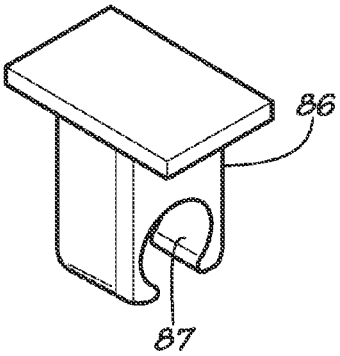
FIG. 7 is a perspective view of the spacer of the anti-sag hinge of FIG. 1.
Figure 4:
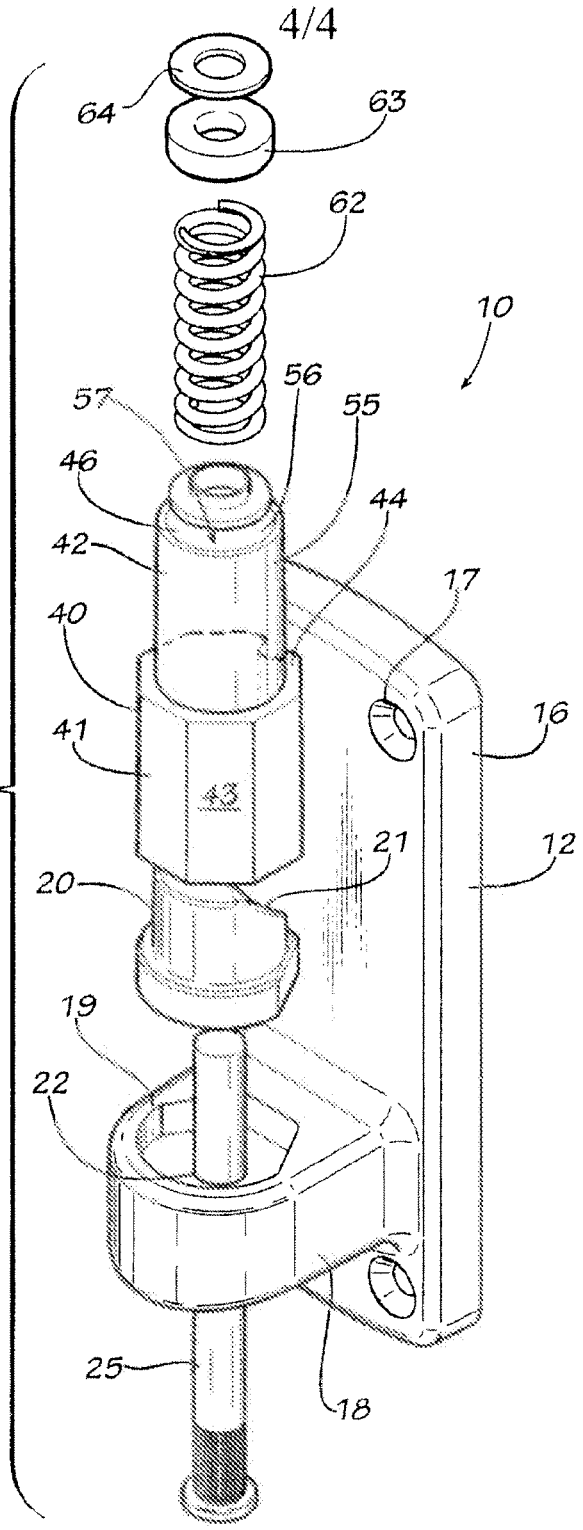
FIG. 4 is an exploded view of the anti-sag hinge of FIG. 1.

With reference next to the drawings, there is shown a lift-off type anti-sag hinge 10 according to the present invention. The hinge 10 includes a mounting flange assembly 12 pivotally coupled to a strap assembly 15. It is to be appreciated that the hinge 10 shown in the drawings is configured for use with a walk-in refrigerator or freezer door. The jamb and doors are well-known in the art and need not be disclosed further herein. It is to be further appreciated that the hinge 10, either alone or in combination with another hinge in accordance with the present invention, support a door (not shown) in the usual manner.

The mounting flange assembly 12 includes a metal mounting plate 16 having four mounting holes 17 therethrough adapted to receiving unshown mounting bolts or screws, and a metal low hinge flange 18 extending from the mounting plate 16. As used throughout the entire disclosure herein, the terms sere and bolt are used interchangeably. The lower hinge flange 18 includes a cam recess 19 configured to receive a cam assembly which has an internally mounted cam 20 and cam follower 40 which enables the hinge to be a riser type hinge, although his is merely option of the present invention. The cam 20 includes a dual sloped camming surface 21. The cam 20 and later described cam follower 40 are preferably made of a smooth, low-frictional plastic material such as nylon. The lower hinge flange 18 also includes a shoulder bolt hole 22 therethrough in which is mounted a shoulder bolt or rod 25.

The strap assembly 15 includes a metal elongated strap 31 extending from a cylinder portion 32. The term cylinder portion 32 is meant to describe the enlarged casing located at the end of the strap and the encased bearings, spring, and cam described in more detail hereinafter. The term cylinder portion is not intended to be limited to a cylinder shape, as this portion or parts of this portion may be of many known shapes and are not necessarily cylindrical in shape.

The cylindrical portion 32 includes a coupling end 34 with a vertically extending octagonal channel 35 therethrough. The octagonal channel 35 includes a generally vertically extending alignment ridge or tongue 36 extending longitudinally along the channel 35 and a centrally positioned, horizontally oriented, annular ridge 37 which generally bisects the channel 35. A cap 38 is pressed into and seals the top opening of the channel 35. The cylindrical portion 32 also houses the elongated cam follower 40 having a lower cam follower portion 41 and an upper cam follower portion 42.

The lower cam follower portion 41 has an octagonal exterior surface 43 terminating at a circumferential ledge or shoulder 44 positioned to abut and bear against the centrally positioned annular ridge 37 of the coupling end 34. It should be noted that the coupling end octagonal channel 35 is longitudinally symmetric about the centrally positioned annular ridge 37 so that the cam follower 40 may be positioned in either end, thereby making it reversible (either left hand or right hand door configurable) so that the cam follower may fit in the octagonal channel 35 from either open end. The lower cam follower portion 41 also has an interior surface 46 with a cam following surface 47 configured to mesh or mate with the cam camming surface 21. The cam following surface 47 includes a low point or low point area 48 flanked on either side by symmetrical incline surfaces which terminate at a common dwell surface. The symmetry allows the cam follower to rise with rotation in either direction so that the hinge may be mounted to both right hand and left hand opening doors. The lower cam follower portion 41 also has a longitudinally extending slot or groove 53 configured to receive the coupling end alignment tongue 36. The groove 53 has a camber 54 in the ledge 44 (cambered entrance) at its top end which aids in initially guiding the tongue 36 into the groove as the strap assembly is coupled with the mounting flange assembly 12 with the cam follower being inserted into the mounting end octagonal channel 35. The groove 53 is aligned along the exterior surface directly opposite the low point 48, so that the groove 53 extends into or corresponds to the longest portion of the camming surface to allow for the greatest degree of strength or minimizing the weakening of component due to the absence of material created by the groove 53.

The upper cam follower portion 42 is generally cylindrical with a round exterior surface 55 and a round interior surface 56 defining an interior channel 57 commencing at an interior floor 58. A bolt or rod hole 59 passes through the center of the cam follower in which resides the shoulder rod 25 so that the cam follower 40 may rotate or pivot about the shoulder rod and relative to the underlying cam 20.

The strap assembly 15 also includes a compression spring 62 positioned concentrically about the shoulder rod 25 and within cam follower interior channel 56. A bushing 63 and washer 64, positioned on top of the bushing 63, are also positioned concentrically about the shoulder rod 25 and within the cam follower interior channel 56. The bushing 63 has a peripheral flange 65 with an annular bottom recess 66 configured to receive a topmost portion of the compression spring 62, which enables the spring 62 to be maintained tightly in position while still allowing lateral room for the spring to expand during spring compression under load, i.e., with the spring under no load there is room between the spring and the interior surface 56 which allows the spring to laterally expand when it is vertically compressed and therefore laterally expanded under a load. The top of the shoulder rod 25 is blunted or deformed to prevent the removal of the washer 64 and thereby the bushing 63 mod spring 62. The compression of the spring 62 biases the cam follower 40 to its lowermost position, which will correlate with the closed position of the refrigerator door or an over-closure position past the closed position of the refrigerator door, and a such the hinge shown in the drawings is a self-closing type hinge.

The strap 31 includes a large interior well or recess 68 having four elongated mounting hole 69, an adjustment screw flange, holder or boss 70 having a screw hole or passageway 71 therein, an upper guide 72 and a lower guide 73. The recess 68 is defined by the sidewalls 74 of the strap 31 which extend to the most outboard portion of the hinge, i.e., a peripheral sidewall 74 which extends outwardly from the underlying door so as to make initial contact with any structure colliding with or impacting upon the hinge. The adjustment screw boss passageway 71 preferably is U-shaped so as to have an open top configuration.

The strap 31 also includes a moveable adjustment bracket 77 mounted for lateral movement relative to the underlying strap 31. The vertical movement of the adjustment bracket 77 is limited by the upper guide 72 and lower guide 73. The adjustment bracket 77 also includes an adjustment screw mounting flange 78 having a threaded screw hole 79 therein in which is threadably mounted an adjustment screw 80. The adjustment screw 80 has ahead 81, a bearing flange 82, a neck 83 extending between the head 81 and bearing flange 82, and an externally threaded shaft 84 which is threaded into mounting flange screw hole 79. A removable spacer 86 is removably mounted to the adjustment screw 80. The spacer 86 has a U-shaped gripping portion 87 which is snap fitted onto a neck portion of the threaded shaft 84 between the bearing flange 82 and the adjustment bracket screw flange 78. Lastly, the adjustment bracket 77 includes four mounting holes 88 extending therethrough and generally in alignment with strap elongated mounting holes 69. A flexible bumper or cover 90 is configured to fit snugly into the top end of the strap recess 68 to protect and seal the interior of the strap assembly, the bumper may include tabs which fit within corresponding tab holes or grooves in the strap.

In use, the hinge 10 is mounted to the refrigerator or freezer door in the conventional manner as is well known in the art. The mounting plate 16 is secured to the jamb by the use of screws (not shown) that extend through the mounting plate mounting holes 17 and into the jamb. A conventional walk-in refrigerator or freezer door is similarly secured to the hinge 10 by four screws (not shown) that extend through the four mounting holes 88 of the strap assembly adjustment bracket 77 and through the four elongated mounting holes 69 of the strap 31. The removable spacer 86 is initially positioned so that the adjustment bracket mounting holes 88 are aligned with the strap mounting holes 69. Once the flange assembly mounting screws are secured and the strap assembly mounting screws are partially secured but not finally tightened, final adjustment of the adjustment bracket may occur to level the door.

To adjust the bracket, the removable spacer 86 is removed and the adjustment screw 80 is rotatably threaded into the threaded hole 79 of the screw adjustment flange 78 to cause relative movement between the adjustment bracket 77 and the underlying strap 31. This relative movement causes the movement of the door relative to the stationary jamb, as the elongated holes 69 allow relative movement of mounting screws and adjustment bracket. The movement of the door enables the door to be properly aligned. The mounting screws are then fully tightened into the door to prevent further of the strap 31. Moreover, should the door sag over time, the mounting screws are slightly loosened and the adjustment screw is merely threaded to once again cause movement of the door to a properly aligned position, as previously described.

The rotation of the adjustment screw 80 in one direction (clockwise) causes the threaded screw 80 to be threaded further into the screw flange 78 of the adjustment bracket 77, thereby causing the adjustment bracket 77 to move towards the boss 70. The rotation of the threaded screw 80 in this direction causes the screw head 81 to bear against the boss 70 to force the lateral movement. The rotation of the adjustment screw 80 in the other direction (counter-clockwise) causes the threaded screw 80 to be threaded further out of the adjustment bracket flange 78, thereby causing the adjustment bracket 77 to move in a direction away from the boss 70. The rotation of the threaded screw 80 in this direction causes the screw bearing flange 82 to bear against the boss 70 to force the lateral movement in a direction away from the boss 70. As such, the bolt is allowed to rotate yet is prevented from moving laterally along the longitudinal axis of the bolt by the contact between the bolt and the boss due to the bolt head and bearing flange bearing upon the boss.

It should be understood that the present invention is an improvement over the prior art shown in U.S. Pat. No. 7,870,642 as the threaded portion in which the adjustment screw is threaded into resides in the removable adjustment plate. This allows the manufacturing of the threads in the mounting hole to occur in a simple manner, as oppose to the prior art which required the threading process to occur on the large, heavy flange of the strap itself, thus complicating the manufacturing process of the hinge and causing a great deal of problems if the threads were not properly formed. Furthermore, if the threads become stripped or damaged only the adjustment bracket needs to be replaced rather than the entire hinge strap.

It should also be understood that the open channel or passageway 71 of the boss allows for the case of positioning the adjustment bracket by simply dropping the adjustment screw neck 83 into the boss wherein the spacer is utilized to maintain the position of the adjustment screw.

It should be understood that the lower portion 41 of the cam follower is not required to be hexagonal in shape and may be of any shaped which aids in preventing relative rotation between the cam follower and its corresponding channel, i.e., it may be oval, any polygonal shape, or any other non-round shape. Preferably, the cam follower has regular polygon exterior configuration wherein all sides and angles are equal, such as the octagonal shape shown in the preferred embodiment.

It should be understood that the terms cam and cam follower may be used interchangeably, as each simply includes a sloping surface configured to ride upon the other's sloping surface.

While this invention has been described in detail with particular reference to the preferred embodiments thereof and the best mode of practicing same, it will be understood that variations and modifications can be effected within the spirit and scope of the invention as described herein above and as set forth in the appended claims.

The invention claimed is:

1. A hinge for use with a refrigerator door designed to rise relative to a surrounding door jamb when moved from a closed position to an open position, said hinge comprising, a mounting flange assembly adapted to be mounted to the jamb of a refrigerator door, said mounting flange assembly having a cam and a rotating cam follower configured to mate with said cam and be moved longitudinally by relative rotational movement between said cam and said cam follower, said cam follower having an exterior surface and a longitudinally extending vertical, alignment groove extending inwardly from said exterior surface, and a strap assembly adapted to be mounted to a refrigerator door, said strap assembly being pivotally coupled to said mounting flange assembly and vertically movably relative to said mounting flange assembly through relative rotation between said cam of said mounting flange and said cam follower coupled to said strap assembly, said strap assembly including a strap having at least one strap mounting hole and a coupling end having a longitudinally extending vertical channel therein configured to receive at least a portion of said mounting flange cam follower, said vertical channel including a longitudinal, vertical alignment tongue extending into said channel and configured to be received within said longitudinally extending vertical alignment groove of said cam follower, whereby the proper alignment between the cam follower and the strap assembly may only occur when the vertical alignment tongue aligns with and is received within the vertical alignment groove.

2. The hinge of claim 1 wherein said cam follower includes a top portion with a generally round exterior shape and a lower portion with a non-round exterior shape, and wherein said longitudinally extending vertical alignment groove extends inwardly into said lower portion.

3. The hinge of claim 1 wherein said cam follower has at least one inclining interior cam surface extending from a low point area, and wherein said longitudinally extending vertical alignment groove extends from said exterior surface directly opposite said low point area.

4. The hinge of claim 2 wherein said cam follower lower portion exterior shape is hexagonal.

5. The hinge of claim 2 wherein said vertical channel further includes an annular ledge positioned to abut a top end of said cam follower lower portion.

6. The hinge of claim 1 wherein said vertical alignment groove has a groove top end with a cambered entrance.

7. A hinge for use with a refrigerator door designed to rise relative to a surrounding door iamb when moved from a closed position to an open position, said hinge comprising, a mounting flange assembly mountable to a refrigerator door iamb having a cam and a generally vertically oriented cam follower configured to engage said cam and be moved vertically by relative rotational movement between said cam and said cam follower, said cam follower having at least a first portion having a select regular polygon exterior configuration having a generally vertically extending exterior alignment groove, and a strap assembly mountable to a refrigerator door and pivotally coupled to said mounting flange assembly and vertical movement relative to said mounting flange assembly through relative rotation between said cam of said mounting flange and said cam follower coupled to said strap assembly, said strap assembly including a strap having a vertical channel therein configured to receive at least a portion of said cam follower first portion, said vertical channel including a longitudinally extending vertical alignment tongue configured to be received within said vertical alignment groove of said cam follower, whereby the proper alignment between the cam follower and the strap may only occur when the vertical alignment tongue aligns with and is received within the vertical alignment groove.

8. The hinge of claim 7 wherein said cam follower has at least one inclining interior cam surface extending from a low point area, and wherein said vertically extending exterior vertical alignment groove extends from said exterior surface directly opposite said low point area.

9. The hinge of claim 7 wherein said cam follower includes a top portion with a generally round exterior shape and a low portion with a non-round exterior shape, and wherein said longitudinally extending vertical alignment groove extends inwardly into said lower portion.

10. The hinge of claim 9 wherein said cam follower lower portion exterior shape is hexagonal.

11. The hinge of claim 9 wherein said channel further includes an annular ledge positioned to abut a top end of said cam follower lower portion.

12. The hinge of claim 7 wherein said vertical alignment groove has a groove top end with a cambered entrance.

13. A hinge for use with a refrigerator door designed to rise relative to a surrounding door jamb when moved from a closed position to an open position, said hinge comprising, a mounting flange assembly mountable to a refrigerator door jamb;

a cam assembly mountable to a refrigerator door and coupled to said mounting flange, said cam assembly having an exterior surface and generally vertical alignment groove extending inwardly from said exterior surface, said cam assembly including a cam and a cam follower configured to rotate relative to said cam for cammed vertical movement of said cam follower, and a strap assembly mountable to a refrigerator door and pivotally coupled to said mounting flange assembly for vertical movement relative to said mounting flange assembly through relative rotation of said cam coupled to said mounting flange and said cam follower coupled to said strap assembly, said strap assembly including a strap having a vertical channel therein configured to receive at least a portion of said cam assembly, said vertical channel including a longitudinally extending vertical alignment tongue configured to be received within said vertical alignment groove of said cam follower, whereby the proper alignment between the mounting flange and the strap assembly may only occur through the orientation of the vertical alignment tongue within the vertical alignment groove.

14. The hinge of claim 13 wherein said cam assembly includes a cam and a cam follower, and wherein said cam follower includes said vertical alignment groove.

15. The hinge of claim 14 wherein said cam follower has at least one inclining interior cam surface extending from a low point area, and wherein said vertical alignment groove extends from said exterior surface directly opposite said low point area.

16. The hinge of claim 14 wherein said cam follower includes a top portion with a generally round exterior shape and a lower portion with a non-round exterior shape, and wherein said vertical alignment groove extends inwardly into said lower portion.

17. The hinge of claim 16 wherein said cam follower lower portion exterior shape is hexagonal.

18. The hinge of claim 16 wherein said channel further includes an annular ledge positioned to abut a top end of said cam follower lower portion.

19. The hinge of claim 13 wherein said vertical alignment groove has a groove top end with a cambered entrance.

* * * * *